United States Patent [19]

Cramer et al.

[11] Patent Number: 4,710,325

[45] Date of Patent: Dec. 1, 1987

[54] ASPIRATING AERATION AND LIQUID MIXING APPARATUS

[75] Inventors: Barry G. Cramer; Roy A. Cramer, both of Kansas City, Mo.

[73] Assignee: Air-O-Lator Corporation, Kansas City, Mo.

[21] Appl. No.: 4,916

[22] Filed: Jan. 20, 1987

[51] Int. Cl.[4] ..... B01F 5/02

[52] U.S. Cl. ..... 261/24; 210/219; 210/220; 210/242.2; 261/76; 261/93; 261/DIG. 75; 366/178; 366/336; 417/198

[58] Field of Search ..... 210/219, 220, 221.2, 210/221.1, 242.2; 261/24, 76, 77, DIG. 75, 93; 366/178, 336; 417/179, 151, 198, 167

[56] References Cited

U.S. PATENT DOCUMENTS

| | | | |
|---|---|---|---|
| 3,371,618 | 3/1968 | Chambers | 261/DIG. 75 |
| 3,734,111 | 5/1973 | McClintock | 261/113 |
| 3,936,382 | 2/1976 | White | 261/DIG. 75 |
| 4,162,971 | 7/1979 | Zlokarnik et al. | 210/220 |
| 4,226,719 | 10/1980 | Woltman | 210/220 |
| 4,259,267 | 3/1981 | Wang | 210/219 |
| 4,308,221 | 12/1981 | Durda | 261/93 |
| 4,322,897 | 4/1982 | Brassfield | 417/179 |
| 4,400,138 | 8/1983 | Baer | 417/179 |
| 4,431,597 | 2/1984 | Cramer et al. | 261/93 |
| 4,443,335 | 4/1984 | Gullace | 210/220 |
| 4,487,553 | 12/1984 | Nagata | 417/198 |
| 4,491,551 | 1/1985 | Johnson | 261/DIG. 75 |
| 4,514,343 | 4/1985 | Cramer et al. | 261/93 |

*Primary Examiner*—Benoît Castel

*Attorney, Agent, or Firm*—Wm. Bruce Day

[57] ABSTRACT

An aspirating aeration and liquid mixing apparatus is positioned in a body of water and includes a motor driven propeller positioned within an intake duct and driving water through a nozzle. A plenum with an air intake pipe extends about the nozzle. The nozzle has ports with ramps thereover to provide a constriction for aspiration. The ramps are spaced annually about the interior of the nozzle with channels between the ramps. As water passes through the nozzle, a low pressure zone is created immediately downstream of the constriction to draw air through the ports, the plenum and the air intake pipe for aeration of the water. Large size materials which could otherwise clog at the constriction pass through the channels substantially unimpeded.

6 Claims, 6 Drawing Figures

ASPIRATING AERATION AND LIQUID MIXING APPARATUS

FIELD OF THE INVENTION

This invention relates to mixers for stirring water in lagoons, ponds and the like, and in particular, to a liquid mixer providing an aeration function.

BACKGROUND OF THE INVENTION

In the mixing and aeration of large bodies of liquid, several different types of mixers have been used, such as floats and pumps. Generally, the floatation types have heretofore been insufficiently controllable in most directions of flow for efficient mixing. Further, most aeration apparatuses used in combination with mixers require various compressors as to applying a source of air to the mixer wherein the compressed air is injected into the liquid medium through nozzles and the like. The compressors generally expend great amounts of energy and increase the total cost of operation of the system.

In other applications, pumps and the like have been used, but these often do not provide sufficient rates of flow for the efficient mixing required in the equalization basins, as well as oxidation ditches, sludge holding tanks and other special applications. Mixers are also used in aerated lagoons in which biological solids are in equilibrium with applied waste. The basin is of sufficient depth, normally six to twelve feet and oxygen is furnished by mechanical aeration to create a turbulence level sufficient to provide adequate liquid mixing. As a result of the mixing, uniform distribution of the waste and dispersal of the oxygen is achieved to promote efficient waste biodegradation.

Aspirating mixers have heretofore been used in aerated sewage logoons, as exemplified by our previous U.S. Pat. No. 4,514,343 for an Aspirating Horizontal Mixer. This aspirator, and other aspirators, require a constriction in order to create a low pressure zone immediately downstream of the constriction, which draws air through a plenum and air intake pipe extending above the surface of the water. However, a problem is noted with such a system in that large sized foreign objects may be drawn in to the nozzle and may block or clog in the constriction, thereby shutting off the flow of water through the nozzle.

In view of the above, the present aspirating aeration and liquid mixing apparatus has been particularly directed to low cost in manufacture, efficient operation, reliability in use, and is designed for mounting upon a mast extending into the body of liquid. The present mixer is of a design permitting total oxygen dispersion throughout an entire basin at relatively low power levels generally not obtainable in the past by the use of prior art devices. Moreover, the present mixer can be used in conjunction with existing surface and subsurface aeration and mixing devices.

OBJECTS OF THE INVENTION

The principal objects of the present invention are: to provide a mixing aerator having a sturdy, sealed motor assembly for submersion within a body liquid; to provide such an aspirating mixer which is mountable upon a typical mast extending into a sewage lagoon; to provide such a mixer in which the critical parts, such as a propeller and motor, are easily accessible for ease of replacement and repair in the field; to provide such a mixer in which almost all of the pumping energy for the propeller is converted to axial flow for efficient exit flow through the body of liquid, resulting in superior mixing and contact interface with the liquid body; to provide such a mixer having an aspiration function, thereby alleviating the necessity for compressors and the like; to provide such a mixer with an aspiration constriction having channels therethrough so the large sized waste materials do not clog the constriction; to provide such a mixer which is energy efficient and has a substantial portion of the energy consumed transmitted to the liquid; and to provide such a mixer having relatively small dimensions and which is light in weight and simple to install.

Other objects and advantages of this invention will become apparent from the following description taken in conjunction with the accompanied drawings wherein are set forth, by way of illustration and example, certain embodiments of this invention.

DESCRIPTION OF THE PREFERRED EMBODIMENT

Figure 2:
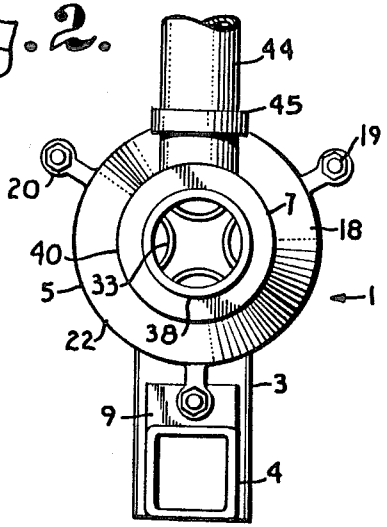
FIG. 2 is an end elevational view of the aspirating aeration and liquid mixing apparatus.
Figure 1:
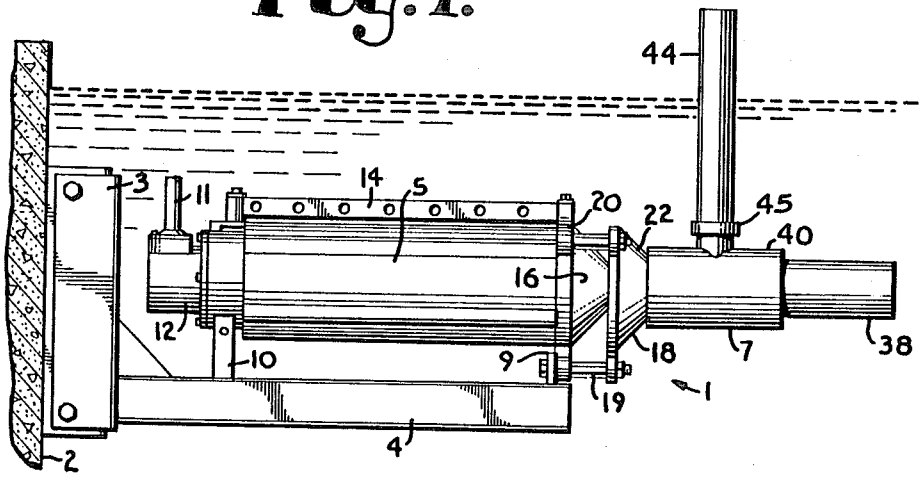
FIG. 1 is a side elevational view of an aspirating aeration and liquid mixing apparatus embodying the present invention.
Figure 3:
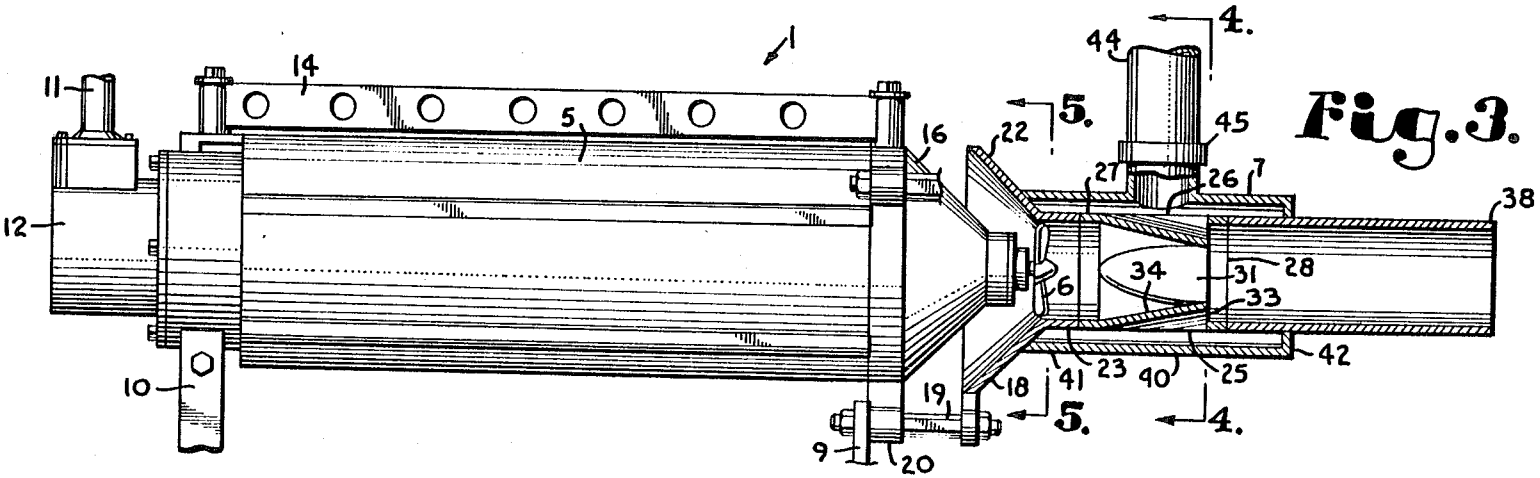
FIG. 3 is an enlarged, fragmentary elevational view of the aspirating aeration and liquid mixing apparatus.
Figure 5:
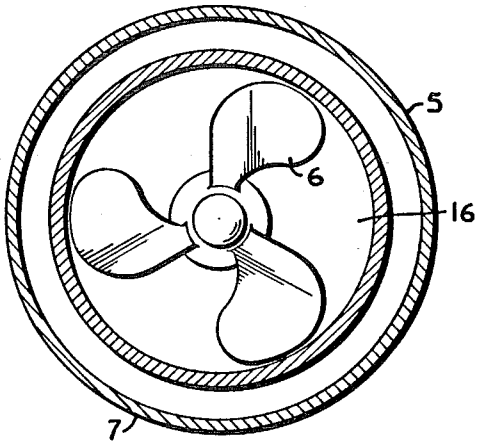
FIG. 5 is a transverse, sectional view of the mixing apparatus taken along lines 5—5, FIG. 3.
Figure 4:
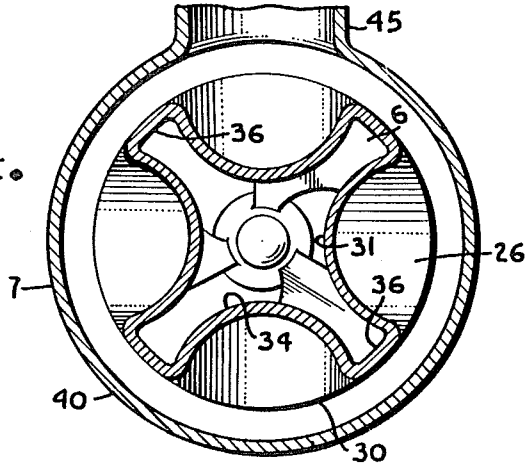
FIG. 4 is a transverse, sectional view of the mixing apparatus taken along lines 4—4, FIG. 3.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail:

The reference numeral 1 generally indicates an aspirating aeration and liquid mixer apparatus embodying the present invention. In overview, the mixer 1 is mounted upon a mast 2 by a slide bracket 3 which may be moved up and down on the mast 2 by a cable (not shown) or fixed in position. A support arm 4 carries a motor assembly 5 which drives a propeller 6. Water is propelled through a nozzle assembly 7 having an internal constriction to create an aspirator. Channels through the constriction permit passage of large sized waste materials which would otherwise clog and block the constriction and disable the mixer 1.

In more detail, the motor assembly 5 is mounted on the support arm 4 by front and rear brackets 9 anddn 10. The motor assembly 5 is submersible and is an electric motor, such as manufactured by Franklin. Preferably, the motor is liquid cooled and lubricated, of stainless steel construction and rated for moderate chemical duty operation. Electrical power is supplied through a power line 11 fitted to the motor by a junction box 12. A lift bar 14 extends along the top of the motor and is fitted with a series of holes for placement of a hoist hook (not shown).

A gear reduction unit 16 is mouned to the front end of the motor assembly 5 to reduce shaft speed and the propeller 6 is mounted on the output shaft of the gear reduction unit 16. The propeller 6 is preferably a hard chromed propeller designed for the specific function of effecting outward flow of the liquid toward and into the nozzle assembly 7. Preferably, the propeller shaft is received in a journal which is hard chromed and bourne by a liquid lubricated cutlass type bearing capable of absorbing substantially all radial and shock loads.

An intake duct 18 is mounted to the motor assembly 5 and gear reduction unit 16 with a space retained between the intake duct 18 and the gear reduction unit 16 for entry of water. In the illustrated example, the inlet entry is annular and formed by spacer bolts 19 extending between paired ears 20. An inlet end 22 of the intake duct 18 is frusto-conical in shape and converges downstream into an annular neck portion 23. When the intake duct 18 is fitted to the gear reduction unit 16, the propeller 6 is received within the neck portion 23. Preferably, the fit is held to very close tolerances whereby the tips of the propeller blades clear the interior surface of the neck portion 23 by approximately 0.002 inch for maximum effectiveness in pumping action.

Figure 6:
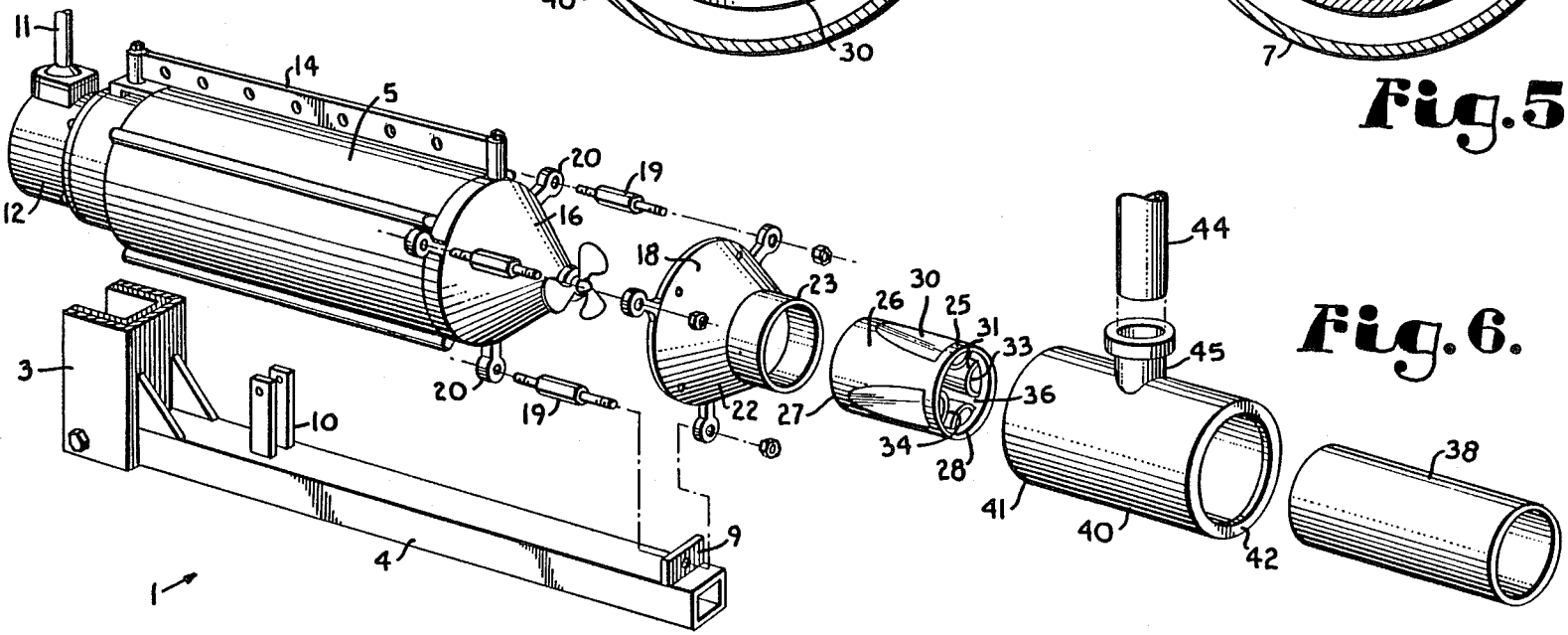
FIG. 6 is a perspective disassembly view of the mixing apparatus.

A nozzle member 25 extends from the neck portion 23 and has a cylinder sidewall 26 and inlet and outlet ends 27 and 28. The nozzle member 25 is generally cylindrical, with the inlet end 27 joined in line with the intake duct neck portion 23. The nozzle member 25, FIG. 6, includes an annular array of passages through the sidewall 26 with ramps thereover to form downstream facing openings. In the illustrated example, the passages 30 are somewhat arcuate or bullet shaped and the ramps 31 thereover comprise longitudinal conical sections which arch over the passages 30 and slope downstream to form an annular array of paired constrictions adjacent the outlet end 28. The ramps 31 are open adjacent the outlet end 28 to provide downstream facing openings 33. Together, the paired ramps 31 form a nozzle constriction 34. An array of channels 36 extend longitudinally between the junctures of the ramps 31 with the sidewall 26 and provide a flow path for large size materials which would otherwise clog at the nozzle constriction 34 during operation of the aerator 1. An outlet duct 38 is longitudinally in line with and connected to the outlet end 28 of the nozzle member 25. The outlet duct 38 preferably has a smooth interior surface for reduction of surface friction as aerated water is expelled through the outlet duct 38.

Sleeved over the nozzle member 25 is a plenum 40. The plenum 40 is of circular construction, of larger diameter than the nozzle member 25, and has a rear end 41 abutting and secured in an airtight connection to the conical inlet end 22 of the intake duct 18. A plenum front end 42 includes an inward ring flange for sealing engagement with the outlet duct 38. An air intake pipe 44 extends upwardly from the plenum 40 for passage of air through the pipe and into the hollow cylindrical plenum. The air intake pipe 44 is connected to the plenum 40 by a fitting 45.

In use, the aerator 1 is placed in a body of liquid, such as a sludge tank, aeration lagoon or fish pond and suitably mounted to the mast 2 or other appropriate support means, such as a float or the like. As the motor 5 is energized, the propeller 6 rotates at high speed within the intake duct 18 to draw a flow of water through the intake duct, the nozzle member 25 and out the outlet duct 38. As the water courses through the nozzle member 25, the ramps 31 at the nozzle constriction 34 cause an immediate drop in pressure coincident with the openings 33 to form an aspirator. Ambient air is drawn through the intake pipe 44, distributed through the plenum 40 and pulled through the openings 33 for mixing with the water flow stream. Any large size articles, such as rags and the like, or sludge fragments which could otherwise clog at the nozzle constriction 34 tend to by-pass the constriction through the channels 36 and are thereafter expelled through the outlet duct 38. The aerated water emitted by the aerator 1 mixes with the water in the tank or pond to aerate same and induce biodegradation within a sewage or sludge lagoon or tank and provide oxygenated water suitable for fish farming operations.

Various forms of the passages 30, ramps 31 and channels 36 may be employed and the by-pass effect of the channels would still be effective. For example, other shapes rather the arcuate, conical or bullet shape may be employed, such as slabs with square sides, and the like. Illustrated herewith is an array of four such passages and ramps with the same number of channels, however, six, eight or other such number, may also be suitably employed, depending on the average size of the larger size particles or materials likely to cause clogging at the nozzle constriction 34.

It is to be understood that while certain forms of the present invention have been illustrated and described herein, it is not to be limited to the specific forms or arrangement of parts described and shown.

What is claimed and desired to be secured by Letters Patent is as follows:

1. An aspirating aeration and liquid mixing apparatus comprising:

(a) pump means generating a high rate, directed flow of liquid, (b) an elongate conduit means mounted in the flow path of said liquid;

(c) an airflow plenum sealed about at least a portion of said conduit means;

(d) an air intake pipe communicating with said plenum;

(e) a nozzle portion constriction in said conduit means and having a plurality of passages through a nozzle portion sidewall and communicating with said plenum; and (f) ramps extending over said passages in convergence to form said constriction, and said ramps having downstream facing openings and providing a low pressure area for drawing air from said plenum and through said intake pipe, said ramps and passages being spaced in an array including channels between said ramps for passage of large sized waste materials.

2. The liquid mixing apparatus set forth in claim 1 wherein:

(a) said ramps have arched, longitudinally sloping surfaces.

3. The liquid mixing apparatus set forth in claim 1 wherein:

(a) said openings are oriented perpendicularly to the longitudinal axis of said nozzle portion.

4. The liquid mixing apparatus set forth in claim 1 wherein:

(a) said array includes four passages with ramps thereover and evenly spaced about said nozzle portion.

5. An aspirating aeration and liquid mixing apparatus comprising:

(a) liquid propulsion means generating a high rate, directed flow of liquid;

(b) an intake duct mounted to said propulsion means to receive the flow path of said liquid and extending into a neck portion;

(c) a plenum joined to said intake duct and sleeved over said neck portion;

(d) an air inlet pipe extending upwardly from said plenum and communicating with a plenum interior;

(e) a nozzle member extending from said neck portion and sleeved within said plenum, said nozzle member having a sidewall and inlet and outlet ends;

(f) an array of passages through said nozzle member sidewall and converging ramps extending over said passages and providing downstream facing openings, thereby forming a constriction for drawing air from said plenum and through said air inlet pipe; and (g) an array of channels between said ramps for passage of large sized waste materials.

6. An aspirating aeration and liquid mixing apparatus comprising:

(a) a motor for submersion in a body of liquid and having a gear reduction unit thereon;

(b) a propeller connected to said gear reduction unit;

(c) an intake duct mounted to said motor and gear reduction unit and spaced therefrom to provide an annular water inlet therearound, said intake duct converging to a neck portion;

(d) said propeller being positioned within said neck portion and having blade tips closely spaced to an interior wall of said neck portion;

(e) a plenum joined to said intake duct and sleeved over said neck portion;

(f) an air inlet pipe extending upwardly from said plenum and communicating with a plenum interior;

(g) a nozzle member extending from said neck portion and sleeved within said plenum, said nozzle member having a sidewall and inlet and outlet ends;

(h) an annular array of passages through the nozzle member sidewall and with sloping, downstream converging ramps extending over said passages and providing downstream facing openings, said ramps providing a constriction for drawing air from said plenum and through said air inlet pipe; and (i) an array of channels between said ramps for passage of any large sized waste materials.

* * * * *